United States Patent [19]

Northrop

[11] Patent Number: 4,758,173

[45] Date of Patent: Jul. 19, 1988

[54] SOCKET ADAPTOR FOR FLUORESCENT LAMP

[75] Inventor: Donald Northrop, Glen Rock, N.J.

[73] Assignee: Duro-Test Corporation, North Bergen, N.J.

[21] Appl. No.: 850,755

[22] Filed: Apr. 11, 1986

Related U.S. Application Data

[63] Continuation of Ser. No. 615,787, May 31, 1984, abandoned.

[51] Int. Cl.[4] ..... H01R 33/08

[52] U.S. Cl. ..... 439/232; 439/236; 439/243

[58] Field of Search ..... 339/50 R, 50 C, 51, 339/52 R, 52 S, 56, 55, 54, 53, 154 A, 154 L; 439/226, 236–244, 232

[56] References Cited

U.S. PATENT DOCUMENTS

| | | | |
|---|---|---|---|
| 2,356,601 | 8/1944 | MacCarthy | 339/53 |
| 2,716,739 | 8/1955 | Lemmers | 339/53 |
| 3,688,244 | 8/1972 | Savoca et al. | 339/154 A |

*Primary Examiner*—Neil Abrams
*Attorney, Agent, or Firm*—Darby & Darby

[57] ABSTRACT

An adaptor for extending tombstone style lamp sockets, as used with fluorescent lamps to permit the use of shorter lamps. The adaptors include pins which are rotated into the standard tombstone style socket and then further include contact openings in a plunger plate movable in a direction along the longitudinal axis of the fluorescent lamp to permit insertion of a fluorescent lamp without the need for rotating it into the tombstone socket.

15 Claims, 3 Drawing Sheets

SOCKET ADAPTOR FOR FLUORESCENT LAMP

This is a continuation, of application Ser. No. 615,787, filed May 31, 1984, now abandoned.

BACKGROUND OF THE INVENTION

This invention pertains to an apparatus for use with fluorescent electrical lamp fixtures having sockets at two of its ends to extend the effective length of the sockets and permit the use of shorter lamps.

Standard ceiling lamp fixtures for use with fluorescent lamps are ordinarily modular in design and fit into standard ceiling troffer modular fixtures. Many such fixtures are designed to accept 4-foot long fluorescent lamps, typically operating at 40 watts each. These modular ceiling fixtures are as short as the 4-foot lamps they are designed to accept. Furthermore, such ceiling fixtures generally are shallow in order to fit into the ceilings and include a reflector spaced only a short distance from the lamp.

In order to replace light bulbs when one or more of the fluorescent lamps has failed, the lamps must be removed diagonally from the fixture due to the short length of the fixture. The metal reflector is also very close to the installed fluorescent lamps and makes installation and removal of the lamp even more difficult. The typical fluorescent lamp of the rapid start type has two bi-pin bases which mate with pairs of standard tombstone type sockets (one located at each end) making it necessary to twist the lamp to install it in or remove it from its pairs of sockets. Due to the closeness of the reflector it is often not possible to get hands or fingers around the bulb and it is therefore necessary to twist the bulb with the fingers only which may be difficult.

Furthermore, tombstone sockets tend to be fragile, usually being made of inexpensive plastic molding having spring contacts therein. During the removal or insertion of the lamps from the tombstone sockets, these sockets are easily damaged neccessitating the replacement of both the lamp and the socket. Maintenance costs for replacement of a lamp may therefore be unexpectedly high.

In addition, it is also difficult to install lamps in modular ceiling fixtures since, in order to insure proper alignment of the lamp pins, it is necessary to be able to see both ends of the lamp at the same time. This is difficult due to the length of the lamp. It is therefore necessary to insert the lamps by "feel" and this also leads to damage to the tombstone sockets.

One solution to this problem would be to use a shorter lamp bulb and a correspondingly shorter fixture in the existing ceiling fixtures. The existing ceiling fixtures, however, cannot accept shorter lamps since the pins of both ends of a fluorescent lamp must be firmly seated against the contacts in the tombstone sockets at either end of the lamp fixture. To use a shorter lamp in a standard 40 watt fixture, an adapter is necessary.

It is known that shorter fluorescent lamps utilize less wattage and produce less light output then a correspondingly longer lamp. Substitution of shorter lamps for the standard lamp will permit a corresponding decrease in energy usage. Where a decrease in lumens output can be tolerated, the energy savings afforded by a shorter lamp can be significant.

SUMMARY OF THE INVENTION

An extender for lamp sockets, particularly for use with tombstone type sockets as used with bi-pin fluorescent lamps, is described permitting plunger installation of fluorescent lamps of a shorter length in ordinary tombstone socketed lamp fixtures. The socket extender includes contacts located within a housing and electrically coupled to pins similar to the pins of a bi-pin fluorescent lamp. The lamp pins are rotated within the tombstone sockets to engage with the tombstone socket contacts. The lamp is inserted into the extender so that its pins make contact with the spring loaded contacts therein which insertion takes place in a direction substantially parallel to the longitudinal axis of the fluorescent lamp.

It is therefore an object of the present invention to provide a socket extender to permit the use of shorter length light bulb in standard ceiling lamp fixtures.

It is a further object to provide energy savings resulting from the use of shorter lamps.

Another object is to provide an adapter that permits the installation of bi-pin base fluorescent lamps in a plunger type installation, in lamp fixtures having tombstone type sockets.

These and other further advantages of the present invention will become apparent upon reference to the annexed specification and drawings.

DESCRIPTION OF THE INVENTION

Figure 1:
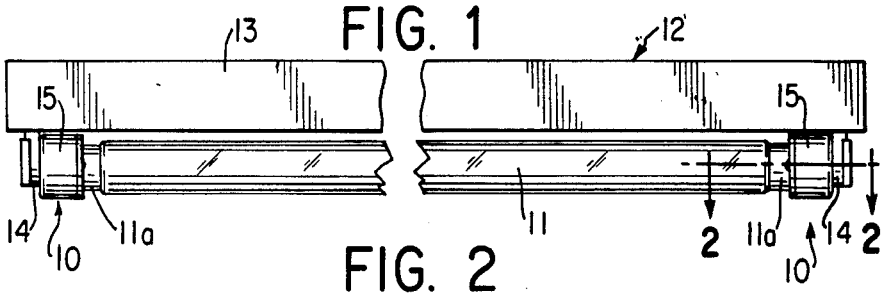
FIG. 1 is an elevational view of a socket extender according to the present invention showing a fluorescent lamp mounted.

Referring to FIG. 1 socket extenders 10 are shown together with lamp 11 installed in fixture 12. Fixture 12 is a standard lamp fixture designed to accomodate standard length light bulbs, typically a 4-foot, 40 watt fluorescent lamp. Fixture 12 includes a base portion 13 and a tombstone socket 14 at each end. The tombstone sockets are of the type well known in the art in which a fluorescent lamp is inserted by sliding it in a direction along a line defined between the two pins of a fluorescent light base and then rotating the lamp 90 degrees in either direction within the tombstone socket to engage with electrical contacts within the tombstone socket. Lamp 11 is similar to a standard fluorescent lamp except that it is not of the standard 4-foot length, but is two to three inches shorter and consquently draws approximately 2 watts less than a standard 4-foot fluorescent lamp. Because of its reduced length, lamp 11 will also provide a 4–5% decrease in lumen output as compared to a standard 4-foot lamp. The length of extenders 10 will be selected to compensate for the difference in length between lamp 11 and the standard lamp for which fixture 12 was designed. It will be understood by those skilled in the art that the present invention is not limited to use in fixtures designed to accept 4-foot lamps, but may be used with any lamp length.

Figure 2:
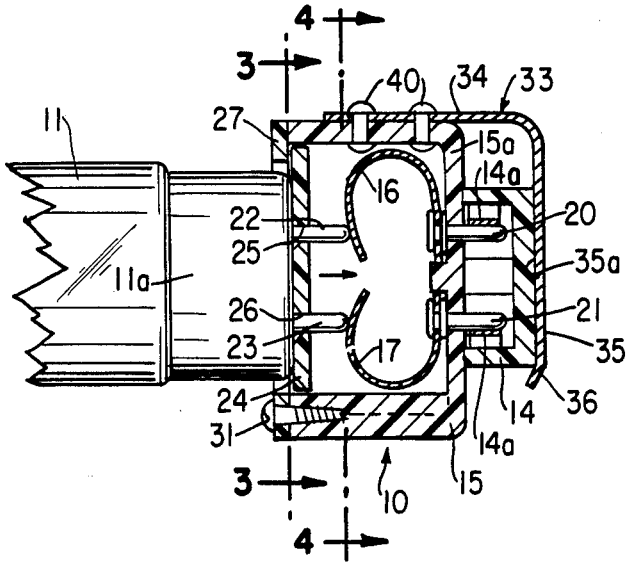
FIG. 2 is a cross-section of the lamp socket extender taken across line 2—2 of FIG. 1.

Referring to FIG. 2 extender 10 comprises a cup shaped base being generally cylindrical and having one substantially closed bottom end. As will be clear from the description below the cylindrical shape of base 15 has a circular cross-section larger than the end cap portion 11*a* of lamp 11. Base 15 is of non-conductive material, for example, plastic.

Spring contacts 16 and 17 are located within base 15 and are affixed to the closed bottom end of base 15 by electrically conductive pins 20 and 21.

Contacts 16 and 17 are leaf spring contacts and may be made of, for example, phosphor bronze or a like material having good electrical and spring characteristics. As shown, each of the contacts 16 and 17 is of C-shaped leaf spring oriented along parallel chords of the circular cross section of base 15. The length of the C-shaped leaf spring contacts 16 and 17 is maximized by this orientation, thus providing a maximized amount of spring curvature and spring travel. In use, contacts 16 and 17 contact fluorescent lamp pins 22 and 23 respectively and provide electrical current and voltage to the cathodes of lamp 11. Contacts 16 and 17 may also be formed in an S-shaped leaf spring or as any other type of spring known in the art. Contacts 16 and 17 should provide good electrical contact to pins 22 and 23 to electrically couple them to pins 20 and 21.

Pins 20 and 21 are coupled to contacts 16 and 17 and mated with tombstone socket contacts 14*a* and 14*b* which are ultimately coupled to the electrical ballast (not shown) for the lamp 11. The electrical ballast may be of any type known in the art and is very often conveniently held in fixture base 13. Pins 20 and 21 are inserted in apertures in contacts 16 and 17 in a frictional fit and are electrically conductive therewith. They are thereafter inserted into the closed end 15*a* of base 15 once again by frictional fit or they may be held in place, e.g. by an adhesive.

Figure 3:
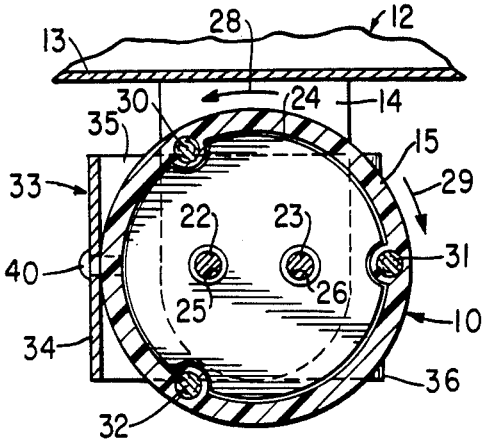
FIG. 3 is a sectional view of the socket extender taken along line 3—3 of FIG. 2.

Plunger plate 24 is circular in shape and has a diameter substantially equal or slightly less than the inner diameter of base 15. If base 15 has a shape other than cylindrical, plunger plate 24 will be similarly shaped and have dimensions and shape selected to substantially match the inner dimensions and shape of a cross section of base 15. Plunger plate 24 includes apertures 25 and 26 which receive lamp pins 22 and 23, respectively. Plunger plate 24 is free to move in a direction along the longitudinal axis of lamp 11, that is in the direction indicated by arrow 25. It is not necessary, or even desirable to permit plunger plate 24 to rotate in the directions shown by curved arrows 28 and 29 in FIG. 3 since such rotation would cause the apertures 26 and 28 to become misaligned with respect to contacts 16 and 17 and thereby prevent good contact between pins 22 and 23 and contacts 16 and 17, respectively. Many methods and apparatus for preventing the rotation of plunger plate 24 may be used, for example, grooves or notches in the perimeter of plunger plate 24 which engage with mating longitudinal ridges in base 15 as shown in FIG. 3.

A lip 27 is formed around an edge of base 15 to prevent plunger plate 24 from being ejected from base 15 by spring contacts 16 and 17. Ring 27 is an annular ring having an inner diameter substantially equal to or larger than the outer diameter of lamp cap 11*a* and an outer diameter substantially equal to the outer diameter of lamp base 15, thus permitting lamp cap 11*a* to be inserted into the inner aperture of ring 27 lamp 11, pins 22, 23 and the subsequent electrical contact of contacts 16 and 17. If the cross section of base 15 is selected to have a configuration that is non circular, the outermost perimeter of lip 27 will then be selected to define a shape substantially the same as the shape of the base 15. Generally, however, the inner apperture of ring 27 will be circular to accept the end cap 11*a* of a fluorescent lamp end cap 11*a* of a fluorescent lamp to be inserted therein.

Lip 27 may be fastened to socket extender base 15 by means of screws 30, 31, and 32 or by any suitable fastening means, e.g. rivets, adhesive, etc.

Locking clip 33 is an L-shaped clip comprised of a first leg 34, a second leg 35, and a clip lock 36. Legs 34 and 35 are generally planar surfaces disposed at substantially right angles with respect to one another. Clip lock 36 also describes a planner surface and extends from second leg 35 at an angle between 90 and less than 180 degrees, being approximately 150 degrees from the surface of leg 35 nearest leg 34. It will be noted that locking clip 33 is so oriented that it has a longitudinal axis taken along leg 35 which is oriented parallel to a line intersecting the center of apertures 25 and 26. Locking clip 33 is fastened to base 15 by rivets 40 and 41 which run through apertures in first leg 34 and into corresponding apertures in a side of base 15. Locking clip 33 is so disposed on base 15 so that a free space is created between the inner surface 35*a* of second leg 35 and the rear surface 15*a* of base 15. The space thus created is selected to be large enough to accommodate a tombstone socket such as socket 14.

Locking clip 33 functions to maintain base extender 10 coupled to tombstone socket 14 even in the absence of a lamp inserted into extender 10. Clip lock 36 extending from second leg 35 further locates locking clip 33 in position over tombstone socket 14. Clip lock 36 snaps over the edge of tombstone socket 14.

Locking clip 33 is generally comprised of a spring like material so that surface 35*a* of second leg 35 will remain pressed against tombstone socket 14.

It will be clear to those skilled in the art that devices other than rivets 40 and 41 may be used for attaching locking clip 33 to base 15, for example, self tapping screws, screws and nuts or adhesives.

During installation socket extender 10 is located so that pins 20 and 21 may enter tombstone socket 14 in the manner customarily used when inserting a standard fluorescent lamp into a tombstone socket. Extender 10 is then rotated 90 degrees in either direction 28 or 29 so that pin 20 and 21 lock into place in tombstone socket 14.

Figure 4:
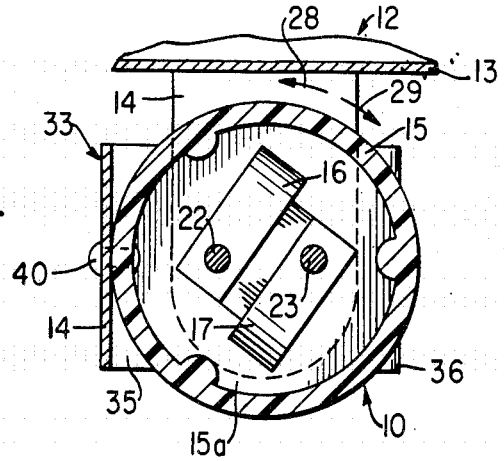
FIG. 4 is a sectional view of the socket extender taken along line 4—4 of FIG. 2.

During rotation of the extender, the leg 35 of locking clip 33 rides over the rear wall of the tombstone socket to assume the position shown in FIGS. 2, 3 and 4 when adapter rotation is completed and stably hold socket extender 10 in position on tombstone socket 14 with clip lock 36 snapping over a lateral edge of tombstone socket 14. Since locking clip 33 is L-shaped, it can rotate around the tombstone socket.

The socket extender thus installed on both ends of fixture 12 receives a fluorescent lamp which is placed so that its pins 22 and 23, are aligned with apertures 25 and 26 in floating plunger plate 24. Lamp pins 22 and 23 presses against the spring contacts 16 and 17. Cap 11*a* will thus be inserted partially into base 15. Thereupon the other end of the fluorescent lamp will clear the outer most portion of the socket extender installed at the other end of the fixture and then may be lifted into position and its corresponding pins 22 and 23 inserted into corresponding appertures 25 and 26. Upon release of the pressure the contacts 16 and 17 at both ends of the lamp will maintain contact against their associated pins at the ends of the fluorescent lamp. There is thus no neccessity for twisting or rotation of the lamp. Furthermore, since the lamp is now two to three inches shorter than a standard lamp, it is easy to insert or remove lamps from a standard fixture.

Figure 5:
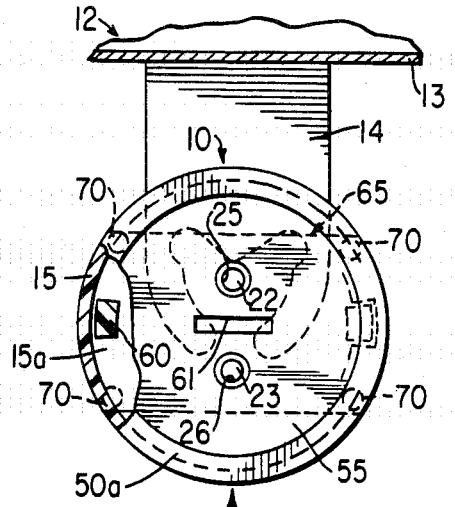
FIG. 5 is a sectional view of another embodiment of a socket extender according to the present invention, shown partially broken away and showing orientation of lamp pin openings in a first direction.
Figure 6:
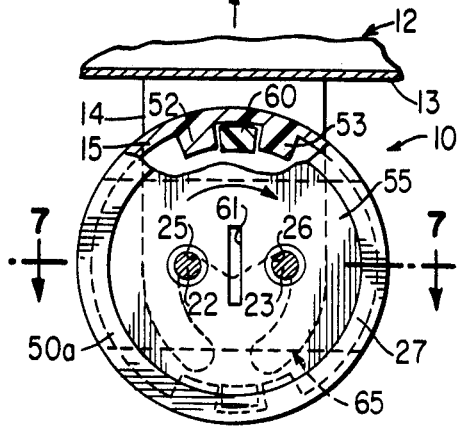
FIG. 6 is a cross-sectional view of the embodiment of FIG. 5 showing the lamp pin openings in a second position.
Figure 7:
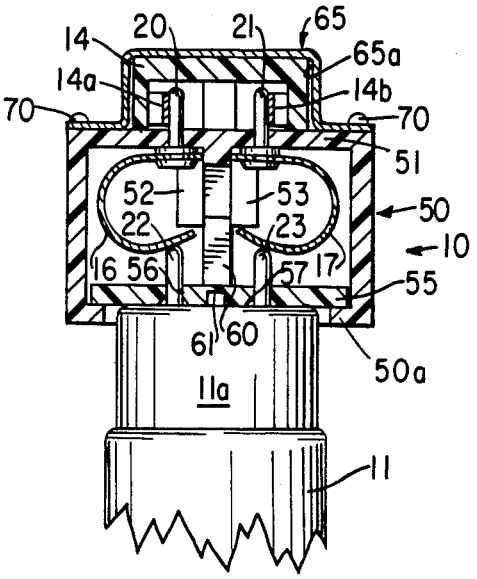
FIG. 7 is a sectional view of the embodiment of FIGS. 5 and 6.

Refer now to FIGS. 5, 6 and 7 where an alternative embodiment according to the present invention is shown in which like elements are referred to by like numerals. In the embodiment of FIGS. 5, 6 and 7, the outer portion of the socket extender 10 is not rotated to engage with the contacts 14*a* and 14*b* of the tombstone socket; only the inner portion is rotated as described below.

As shown in FIG. 7 the socket extender 10 includes a hollow cylindrical shell 50 having contacts 16 and 17 therein coupled to pins 20 and 21 which are in turn affixed to a rotating plate 51 in the same manner as previously described with respect to base 15 shown in FIG. 2. Protuberances 52 and 53 are spaced apart from one another and are rigidly affixed to rotational plate 51. They have a substantially rectangular cross section and are of approximately equal height.

Plunger plate 55 rests within base 50 having an outside diameter substantially equal to the inside diameter of shell 50. As previously discussed with respect to plunger plate 24 and base 15, plunger plate 55 will have an outer diameter and perimeter shape substantially matching the inner diameter and shape of shell 50. Plunger plate 55 will also include two apertures 56 and 57 corresponding to apertures 25 and 26 which receive the fluorescent lamp pins 22 and 23 therein.

Plunger plate 55 also includes a protrusion 60 and a recess or slot 61. Protrusion 60, generally rectangular in cross section extends orthogonally to the surface of plunger plate 55 and has shape and dimension selected to fit in the space between protruberances 52 and 53. Slot 61 is adapted to receive a turning force such as may be applied with a screwdriver. Thus, plunger plate 55 unlike plunger plate 24 of the previously described embodiment, is designed to rotate in a direction indicated by arrows 28 and 29 in FIG. 6.

When a turning force is applied to plunger plate 55, as for example, by a screwdriver inserted into slot 61, rotational plate 51 will also rotate in the same direction by virtue of the coupling engagement between protrusion 60 and protruberances 52 and 53. When the socket extender of FIG. 4 is coupled to a tombstone socket the pins 20 and 21 and locked in place by turning of the plunger plate 55 by a tool inserted into slot 61 instead of rotation of the shell 50.

Shell 50 also include a lip 50*a* corresponding to the lip 27 of the previously described embodiment. Lip 50*a*, as shown in FIG. 7, is an integral portion of casing 50. In the instance where casing 50 is molded from plastic, lip 50*a* will be a integral part of the molding. Alternatively, lip 50*a* may be applied as lip 27 with rivets, adhesives or other attaching devices.

The socket extender of FIG. 6 also includes support clip 65 which is affixed to casing 50 by rivets 70, 71, 72 and 73. Support clip 65 may also be attached to casing 50 by self-tapping screws, adhesives or other methods known in the art.

Support clip 65 is generally of sheet metal formed to have a rectangular recess 65A between two outer planar regions 65B and 65C attached to casing 50. Rectangular recess 65A has dimensions and shape adapted to receive a tombstone socket. The metal support clip 65 performs the same functions as locking clip 33 and retains socket extender 10 as shown in FIGS. 5, 6 and 7 on a tombstone socket without a lamp being inserted therein. Unlike locking clip 33, metal support clip 65 is fastened around its perimeter to casing 50. Clip 65 need not be turned about tombstone socket 14 since appropriate contact between pins 20 and 21 and the contacts 14A and 14B of tombstone sockets 14 is accomplished by means of the twising or rotation of rotating plate 51.

Insertion and removal of a fluorescent lamp from a ceiling fixture equipped with the socket extenders 10 of FIGS. 5, 6 and 7 is performed in the same manner as described for the socket extenders of FIGS. 2, 3 and 4. This socket extender is utilized by sliding the rectangular recess 65*a* of metal support clip 65 over the end of the tombstone socket which is thus held in place. As previously stated, and as in the normal installation of a fluorescent lamps the pin 20 and 21 must be properly aligned so that they may slide into the tombstone socket and then be rotated by means of a turning force supplied through slot 61.

Figure 8:
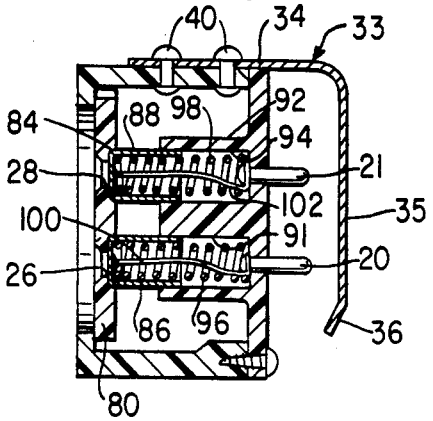
FIG. 8 is a sectional view of another embodiment of the invention.

FIG. 8 is a cross-sectional view of an embodiment of the invention having the same external configuration shown by and described for FIG. 3, but having a different internal configuration. In FIG. 4 the plunger plate 80 includes two recesses 82 and 84 in alignment with apertures 26 and 28, respectively. Hollow brass cup contacts 86 and 88 are seated within recesses 82 and 84 being biased into that position by compression springs 96 and 98. Cup contacts 86 and 88 are generally elongate, hollow cylinders having closed lower ends and open upper ends.

The rear wall 90 of the adapter is disposed opposite plunger plate 80 and includes wells 92 and 94 extending from the rear wall 90 into the adapter. The wells 92, 94 have an internal diameter sufficient to receive and permit sliding motion of contacts 86 and 88. The pins 20, 21 to be inserted into the tombstone socket 14 are located on the wall 90.

Compression springs 96 and 98 are located within the interior of contacts 86 and 88 and wells 92 and 94, within which they are supported, and may optionally be electrically conductive.

Conductors 100 and 102 are electrically coupled by welding to the interior of contacts 86 and 88 and further electrically coupled to pins 23 and 22, which are seated in pin support plate 90. Conductors 100 and 102 can also be electrically coupled by other methods known in the art.

In operation, a fluorescent lamp bi-pin contacts are inserted into apertures 26 and 28 making contact with cup contacts 86 and 88. Springs 96 and 98 assure stable conduction between the lamp pins and contacts 86 and 88. Conductors 100 and 102 in turn assure conduction between contacts 86 and 88 and pins 20 and 21, respectively.

As described above, pins 23 and 22 are inserted into a standard tombstone socket.

The previously described socket extenders according to the present invention, when properly installed, will provide positive pin contact at all times. Since there is no improper orientation or likelihood of pins slipping off the contact during installation, lamp life is enhanced. The extenders may be easily and quickly installed without the need for special tools or modification of existing equipment. Additionally, the socket extenders can be removed at any time to permit the return of a standard size lamp to the fixture. Furthermore, the socket extender provides ease of installation through the use of plunger type sockets and consequently can lead to savings in maintenance costs.

The use of the socket extender may also provide substantial energy savings. Since the lamp is generally on the order of two to three inches shorter than a standard lamp, it can provide savings of two to three watts of consumed energy with a conventional lamp, for example, an argon filled lamp. While there are a number of reduced energy consuming lamps which have been used to save energy in existing lighting installations, these lamps generally may not be used under all conditions, particularly at low temperatures. These are often krypton-neon or krypton-argon filled lamps which generally must be used at temperatures above 50 degrees Fahrenheit. Even at temperatures above 50 degree Fahrenheit, such lamps may flicker and be difficult to start. Shorter lamps using the standard argon fill gas will still provide a savings in energy yet retain the ease of starting of a standard lamp. Furthermore, lamp maintenace and discoloration is the same as in regular lamps, which is generally better then that in the energy saving krypton-neon or krypton-argon lamps.

Generally, energy saving lamps may, due to the different requirements of lamps having this type of fill gas, strain the ballast. When utilizing the present invention, the energy savings are realized without straining the ballast.

For even greater energy savings, the shorter lamps may also be made with a krypton-neon or krypton-argon fill gas for those environments where such lamps can be used. Thus, even greater energies savings are possible. For example, a typical energy saving 48-inch lamp uses 34 watts while a 46-inch lamp would consume approximately 32 watts. Additionally, the shorter krypton-neon or krypton-argon filled lamps will show better starting than the standard length lamps using the same fill gas.

Given enough space within the socket extender various types of electronic circuitry may be included. For example, a transformer could be contained within the adapter. Currently, there are lamps being sold as energy saving lamps including a special transformer and capacitor within the lamp to permit the use of a lamp having different parameters and operating characteristics then a standard fluorescent lamp. These lamps incorporate the ballast system within the lamp. Thus the ballast system is discarded every time the lamp is replaced. Insertion of the ballast or ballast modifying system within the adapter would permit savings upon replacement.

It would also be possible to put in a timed cathode cut off switch so that after the lamp is operating the heating current to the lamp cathodes is removed. This would save much of the energy in heating and permit lower energy consumption.

What is claimed is:

1. A socket adaptor for a reduced length elongated fluorescent lamp having two opposed ends each with a pair of outwardly projecting electrical terminals thereon, said lamp to be mounted in a lamp fixture having a pair of spaced tombstone type sockets each having pairs of electrical contacts thereon mounted in opposition at the ends of a longitudinal axis of greater length than said reduced length lamp, the two electrical terminals at each end of a fluorescent lamp being inserted into a respective tombstone socket by a rotating action, said adaptor for converting rotating type installation of said lamp into plunger type installation and wherein the improvement comprises:

a housing having a first and a second end;

a pair of projecting electrically conductive pins mounted at said housing second end, each of said pins adapted to engage and make electrical contact with one of said electrical contacts in a tombstone socket of a fixture upon rotatable insertion of said housing and the electrically conductive pins thereon into the electrical contacts of a tombstone socket;

means at said first end of said housing having a pair of apertures into which the pair of projecting electrical terminals at an end of said reduced length lamp are to be inserted in a substantially straight line motion from said first to said second end of said housing;

a respective electrical contact means aligned with each aperture at said first end of said housing for making electrical contact with a respective lamp terminal as the lamp is inserted therein toward said second housing end, each of said electrical contact means being electrically connected to a respective conductive pin at said second end of said housing;

means for resiliently biasing said electrical contact means in a direction toward said first end of said housing against the direction of force of insertion of the pair of electrical terminals at an end of said reduced length lamp;

and a spring loaded locking clip external of said housing for attaching said adaptor to said tombstone socket, said clip having a first legg and a second leg disposed perpendicular to each other, one of said legs coupled to said housing and the other of said legs lying generally parallel to said housing second end and spaced therefrom at a distance sufficient to receive the tombstone socket in the space between said other leg and said housing second end.

2. The socket adaptor according to claim 1 wherein said electrical contact means comprises electrically conductive springs which also form said resilient biasing means.

3. The socket adaptor according to claim 2 further comprising a plunger plate having said apertures therein, said apertures being aligned with said springs, said plunger plate being movable in a direction parallel to said longitudinal axis.

4. The socket adaptor according to claim 3 wherein said second end of said housing is rigidly coupled to said housing and said conductive pins are rigidly coupled to said second end, whereby rotation of said housing will rotate said pins.

5. A socket adaptor as in claim 1 further comprising a generally planar clip lock at the end of said other leg at a distance sustantially equal to the width of said tombstone socket and extending therefrom at an angle in the range of from between about 90 degrees to less than 180 degrees to engage said tombstone socket to lock the clip and the coupled adaptor thereto.

6. A socket adaptor for reduced length elongated fluorescent lamp having two opposed ends each with a pair of outwardly projecting electrical terminals thereon, said lamp to be mounted in a lamp fixture having a pair of spaced tombstone type sockets each having a pair of electrical contacts thereon mounted in opposition at the ends of a longitudinal axis of greater length than said reduced length lamp, the two electrical terminals at each end of a fluorescent lamp being inserted into a respective tombstone socket by a rotating action, said adaptor for converting rotating type installation of said lamp into plunger type installation and wherein the improvement comprises:

a housing having a first and a second end;

a pair of projecting electrically conductive pins rigidly mounted at said housing second end, each of said pins adapted to engage and make electrical contact with one of said electrical contacts in a tombstone socket of a fixture upon rotatable insertion of said housing which causes rotation of the electrically conductive pins thereon into the electrical contacts of a tombstone socket;

a plunger plate at said first end of said housing having a pair of apertures into which the pair of projecting electrical terminals at an end of said reduced length lamp are to be inserted in a substantially straight line motion from said first to said second end of said housing, said plunger plate being movable in a direction parallel to said longitudinal axis;

a respective electrically conductive spring contact means aligned with each aperture of the plunger plate at said first end of said housing for making electrical contact with a respective lamp terminal as the lamp is inserted therein toward said second housing end, each of said spring contact means being electrically connected to a respective conductive pin at said second end of said housing;

each said spring contact means producing a resilient biasing force in a direction toward said first end of said housing against the direction of force of insertion of the pair of electrical terminals at an end of said reduced length lamp into said apertures of said plunger plate;

and means adjacent said first end of said housing for retaining said plunger plate within said housing.

7. The socket adaptor according to claim 6 wherein said plunger plate retaining means comprises a ring abutted against said first end of said casing, said ring having an inner diameter adapted to receive an end of said lamp and an outer diameter adapted to be affixed to said housing.

8. The socket adaptor according to claim 6 further including means disposed within said housing for controlling current applied to said lamp.

9. A socket adaptor as in claim 6 wherein each said spring contact means comprises a leaf spring having an arcuate shaped portion, said leaf spring having one part electrically connected to a respective conductive pin and an area aligned with and overlying a respective aperture of said plunger plate for making electrical contact with a respective lamp terminal as the lamp is inserted therein toward said second housing end, each said arcuate shaped portion of said leaf spring producing a resilient biasing force in a direction toward said first end of said housing against the direction of force of insertion of the pair of electrical terminals at an end of said reduced length lamp into said apertures of said plunger plate.

10. A socket adaptor for a reduced length elongated fluorescent lamp having two opposed ends each with a pair of outwardly projecting electrical terminals thereon, said lamp to be mounted in a lamp fixture having a pair of spaced tombstone type sockets each having a pair of electrical contacts thereon mounted in opposition at the ends of a longitudinal axis of greater length than said reduced length lamp, the two electrical terminals at each end of a fluorescent lamp being inserted into a respective tombstone socket by a rotating action, said adaptor for converting rotating type installation of said lamp into plunger type installation and wherein the improvement comprises:

a housing having a first and a second end;

a pair of projecting electrically conductive pins mounted at said housing second end, each of said pins adapted to engage and make electrical contact with one of said electrical contacts in a tombstone socket of a fixture upon rotatable insertion of said housing and the electrical by conductive pins thereon into the electrical contacts of a tombstone socket;

means at said first end of said housing having a pair of apertures into which the pair of projecting electrical terminals at an end of said reduced length lamp are to be inserted in a substantially straight line motion from said first to said second end of said housing;

a respective electrically conductive contact means formed by a leaf spring having an arcuate shaped portion, said leaf spring having one part electrically connected to a respective conductive pin and an area aligned with and overlying a respective aperture at said first end of said housing for making electrical contact with a respective lamp terminal as the lamp is inserted therein toward said second housing end, each said arcuate shaped portion of said leaf spring producing a resilient biasing force in a direction toward said first end of said housing against the direction of force of insertion of the pair of electrical terminals at an end of said reduced length lamp.

11. A socket adaptor as in claim 10 wherein said arcuate shaped leaf spring is generally C-shaped.

12. A socket adaptor for a reduced length elongated fluorescent lamp having two opposed ends each with a pair of outwardly projecting electrical terminals thereon, said lamp to be mounted in a lamp fixture having a pair of spaced tombstone type sockets each having a pair of electrical contacts thereon mounted in opposition at the ends of a longitudinal axis of greater length than said reduced length lamp, the two electrical terminals at each end of a fluorescent lamp being inserted into a respective tombstone socket by a rotating action, said adaptor for converting rotating type installation of said lamp into plunger type installation and wherein the improvement comprises:

a housing having a first and a second end;

a pair of projecting electrically conductive pins mounted at said housing second end, each of said pins adapted to engage and make electrical contact with one of said electrical contacts in a tombstone socket of a fixture upon rotatable insertion of said housing and the electrically conductive pins thereon into the electrical contacts of a tombstone socket;

means at said first end of said housing having a pair of apertures into which the pair of projecting electrical terminals at an end of said reduced length lamp are to be inserted in a sustantially straight line motion from said first to said second end of said housing;

a pair of hollow wells formed on the interior of said housing second end;

a respective hollow elecltrically conductive cup contact means aligned with a respective well and with each aperture at said first end of said housing for making electrical contact with a respective lamp terminal as the lamp is inserted therein toward said second housing end;

an electrical conductor connected between each of said cup contact means and a respective conductive pin at said second end of said housing;

and a compression spring disposed within each of said cup contact means and its aligned well for resiliently biasing said cup contact means in a direction toward said first end of said housing against the direction of force of insertion of the pair of electrical terminals at an end of said reduced length lamp.

13. A socket adaptor for a reduced length elongated fluorescent lamp having a two opposed ends each with a pair of outwardly projecting electrical terminals thereon, said lamp to be mounted in a lamp fixture having a pair of spaced tombstone type sockets each having a pair of electrical contacts thereon mounted in opposition at the ends of a longitudinal axis of greater length than said reduced length lamp, the two electrical terminals at each end of a fluorescent lamp being inserted into a respective tombstone socket by a rotating action, said adaptor for converting rotating type installation of said lamp into plunger type installation and wherein the improvement comprises:

a housing having a first and a second end;

a pair of projecting electrically conductive pins mounted at said housing second end, each of said pins adapted to engage and make electrical contact with one of said electrical contacts in a tombstone socket of a fixture upon rotatable insertion of said housing and the electrically conductive pins thereon into the electrical contacts of a tombstone socket;

a plunger plate at said first end of said housing having a pair of apertures into which the pair of projecting electrical terminals at an end of said reduced length lamp are to be inserted in a substantially straight line motion from said first to said second end of said housing;

a respective electrically conductive spring contact means aligned with each aperture of the plunger plate at said first end of said housing for making electrical contact with a respective lamp terminal as the lamp is inserted therein toward said second housing end, each of said electrical contact means being electrically connected to a respective conductive pin at said second end of said housing, each said spring contact means producing a resilient biasing force in a direction toward said first end of said housing against the direction of force of insertion of the pair of electrical terminals at an end of said reduced length lamp into said apertures of said plunger plate; and plunger plate engaging means extending from said second end toward said first end of said housing and mating engaging means on said plunger plate for mechanically coupling said plunger plate to said housing, rotation of said plunger plate rotating said housing and the pins thereon.

14. The socket adaptor according to claim 13 wherein said plunger plate further includes a slot for receiving a tool to rotate said plunger plate.

15. A socket adaptor as in claim 13 wherein said mating engaging means comprises a slot formed on the housing wall between its first and second ends and projection on said plunger plate which projects into said slot.

* * * * *